US006226931B1

(12) United States Patent
Haversat

(10) Patent No.: US 6,226,931 B1
(45) Date of Patent: May 8, 2001

(54) MODULAR DISPLAY SYSTEM

(75) Inventor: Mark A. Haversat, Monroe, CT (US)

(73) Assignee: Canfield Industries, Inc., Bridgeport, CT (US)

( * ) Notice: Subject to any disclaimer, the term of this patent is extended or adjusted under 35 U.S.C. 154(b) by 0 days.

(21) Appl. No.: 09/325,816

(22) Filed: Jun. 4, 1999

(51) Int. Cl.[7] ..... E04C 2/38; E04B 2/00

(52) U.S. Cl. ..... 52/71; 52/36.1; 52/238.1; 52/243; 52/239; 160/135; 160/351

(58) Field of Search ..... 52/71, 64, 65, 52/70, 36.1, 238.1, 243, 127.1, 239, 475.1; 160/135, 351, 354, 371, 381

(56) References Cited

U.S. PATENT DOCUMENTS

| | | | | |
|---|---|---|---|---|
| 3,349,427 | | 10/1967 | Cairns et al. . | |
| 3,677,322 | | 7/1972 | Brorson et al. . | |
| 4,103,465 | * | 8/1978 | McDonald | 52/127 |
| 4,662,128 | | 5/1987 | Eberdt et al. . | |
| 4,761,922 | * | 8/1988 | Black | 52/71 |
| 4,864,691 | | 9/1989 | Gidseg et al. . | |
| 4,982,535 | | 1/1991 | Pickett . | |
| 5,107,639 | | 4/1992 | Morin et al. . | |
| 5,219,406 | * | 6/1993 | Raz | 160/135 |
| 5,287,909 | * | 2/1994 | King et al. | 160/135 |
| 5,425,157 | | 6/1995 | Chang . | |
| 5,857,510 | | 1/1999 | Krupke et al. . | |
| 5,878,802 | * | 3/1999 | Richter et al. | 160/135 |

* cited by examiner

*Primary Examiner*—Christopher T. Kent
*Assistant Examiner*—Jennifer I. Thissell
(74) *Attorney, Agent, or Firm*—DeLio & Peterson, LLC

(57) ABSTRACT

A modular display system includes base units angularly positionable relative to one another on a floor area to define a lower edge of a display space. Base units include an elongated body and a pair of detachable end members connectable to the opposed ends of the elongated body at upper or lower positions. An end member connected at a lower position at one end of the body is connectable at a plurality of angles to an end member on an adjacent base unit connected at the upper position. The angular connection allows the display area to be defined and adjusted prior to installation of vertical elements forming walls. Vertical supports, preferably including columns positioned over the end members between the base units and uprights supported in sleeves in the base units are removably connectable to the base units. Crossbars are removably connectable to the upper ends of the vertical supports for defining an upper edge of the display space. Sheet material displays are positionable on the base units, vertical supports and crossbars to define walls. Electrical outlets are integrated into the system and attachment points for display accessories and shelves are provided.

19 Claims, 8 Drawing Sheets

MODULAR DISPLAY SYSTEM

BACKGROUND OF THE INVENTION

1. Field of the Invention

This invention relates to display systems of the type commonly used at trade shows, conventions and in public areas to display goods or offer services for sale and which define a display area and separate it from the display areas of other vendors.

2. Description of Related Art

Trade shows and conventions have become an important avenue for introducing new products and services to potential customers. Vendors have a need for a reliable display system that can be quickly assembled and disassembled to establish a display area. The display system must be easily transportable between display locations, must be structurally sound, self supporting and adaptable to produce differently shaped display areas to accommodate varying requirements at different exhibition venues.

It is highly desirable for the display system to define the display area as a booth or enclosure with walls providing vertical display areas on the inside and outside wall surfaces. The walls must provide support for vertical displays having significant weight, but it is desirable to minimize the weight and size of the structure itself to simplify transportation. Simultaneously, it is desirable for the display area floor plan to be adjustable during assembly to refine the shape and size of the display area.

A further need is to have a display system that provides power for lighting, animated displays, computer systems and the like, and which allows communication or other control cables to be positioned out of the way of people moving within the display area.

Display systems that are presently available fail to meet many of these requirements. Current display systems that provide vertical display space use partition walls. Partition wall systems tend to be heavy and difficult to adjust during assembly because the entire partition wall must be moved or repositioned each time a change is desired. Another difficulty with partition wall systems is the lack of integrated electrical wiring. Consequently, electrical cables and any specialized communication or control cables must be strung after the display is set up, and the cables become a tripping hazard.

Another difficulty with partition walls systems is that some designs do not accommodate connections between the walls at all angles. In some designs only ninety degree angles or straight line connections are allowed between the walls. In those designs which do provide angular connection capability between the partitions, the partitions often cannot be connected in acute angles, i.e. less than ninety degrees.

A further problem with partition wall systems is that some are not designed to be free standing and need connection to adjacent walls in order to achieve rigidity. Those designs that do permit a single partition wall to free-stand must have support legs for each wall. The support legs interfere with storage of the walls during transport, and seldom provide the desired stability for the wall.

Yet another problem is that the height of the walls in prior art partition wall display systems is limited, principally due to weight considerations. It is also difficult to construct openings in the display area other than by omitting a complete partition wall.

Bearing in mind the problems and deficiencies of the prior art, it is therefore an object of the present invention to provide a display system which is modular and constructable in portions, including a first lower portion allowing the outline of the display area to be positioned and adjusted, followed by a light-weight but structurally sound vertical portion to define the walls of the display area.

It is another object of the present invention to provide a display system which includes integrated power and includes room for additional control cables and/or communications cables.

Yet another object of the present invention is to provide a display system that provides for back illuminated displays.

A further object of the invention is to provide a display system that allows the attachment of various display accessories.

Still another object of the present invention is to provide a display system that allows multiple walls to connect together at a single point in a star configuration and which allows walls to connect at any desired angle, including acute angles.

Still other objects and advantages of the invention will in part be obvious and will in part be apparent from the specification.

SUMMARY OF THE INVENTION

The present invention comprises a modular display system in which base units are angularly positionable relative to one another on a floor area to define a lower edge of a display space. Each base unit includes an elongated body defining a portion of the perimeter of the display area. The elongated bodies have opposed ends and detachable end members that are connectable to the opposed ends of the body at an upper position or at a lower position. An end member that is connected to the body at the lower position is connectable at a plurality of different angles to an end member on an adjacent base unit having its end member connected at the upper position.

The base units are positioned on the display floor to define the perimeter of the desired display area. The angle between adjacent base units is preferably continuously adjustable at the connection between the end members from 180°, i.e., straight, to acute angles on either side, most preferably as small as 60° to each side , allowing equilateral triangle perimeters to be constructed and providing a total range of adjustment of 240°.

After the perimeter of the display area is defined with the base units, a plurality of vertical supports are installed and connected to the base units for supporting display material. The lower ends of the vertical supports are connected to the base units and the upper ends of the vertical supports engage corresponding crossbars that define an upper edge around the perimeter of the display space.

In the preferred design, there are two different types of vertical supports. One type includes columns that engage the end members on the base units. The other type includes uprights that are supported by sleeves in the bodies of the base units. The columns provide significant vertical structural strength and define the vertical dimensions of the walls. They also provide a modern appearance to the display system. The uprights fit within sleeves in the body of the base unit and crossbars extend between the uprights. The uprights and crossbars are preferably used as a frame to support flexible sheet material containing advertisements, posters or the like. Alternatively, the uprights may be integrated with light units providing back lighted graphics with transparent or semi-transparent coverings for displays. In the preferred design, the crossbars extend between both the uprights and the columns providing great structural rigidity to the display system.

Additional features allow the vertical columns to support shelves or displays. Openings along an upper surface of the base unit allow additional display accessories to be attached thereto.

The base units are preferably hollow and are provided with removable covers allowing access to the interior where electrical outlets are positioned. Electrical wiring including plugs and receptacles extend between the opposed ends of base and into the end members allowing the base units to be plugged together end to end in chainlike fashion to provide electrical power around the entire outer perimeter of the display area. Openings in the base units also allow corresponding communication and/or control cables to be placed within the base units. The vertical columns preferably receive spiders at the top that connect to the crossbars and upper ends of the uprights. The spiders are adjustable to any desired angle corresponding to the angle between adjacent base units. The columns are designed to be extended vertically by extension columns.

In the most highly preferred design, the end members are cylindrical column collars that are attached at either the upper or lower position on each end of the base. The lower column collar on a base receives a column ring and the upper column collar on an adjacent base unit is then positioned on top of the column ring, the column ring allowing the angle between the base units to be continuously adjustable to any angle between the angular limits.

Notched column rings at the tops of columns are designed to fit over spider connectors allowing the columns to be extended vertically by attaching a column extension. The notched column ring holds the extension firmly to the top of a column attached at its bottom to the connection point between adjacent base units. The columns include slots for receiving accessories such as shelves and display supports. Specialized column collars allow multiple base units to be connected at their ends in a star configuration including three or more base units where it is desirable to provide interior or exterior walls extending into or out of the perimeter of the display area.

The design of the invention allows extremely compact storage as the vertical elements are all elongated structures which may be laid on their sides parallel to the elongated base units for storage and transportation. The design also facilitates accurate positioning and alignment of sheet material displays. The bottom of the sheet is attached to an overlay base tab which accurately defines the lower edge of the sheet material for alignment with the base unit. The overlay base tab has a series of tabs that engage corresponding slots positioned along the upper surface of the base unit. The tabs on the overlay base tab are inserted into the slots in the base unit. This ensures that the sheet material is square relative to the base. The sheet material is then rolled or pushed upwards from the base, with the overlay base tab maintaining the alignment until the top of the display sheet reaches the crossbar.

BRIEF DESCRIPTION OF THE DRAWINGS

The features of the invention believed to be novel and the elements characteristic of the invention are set forth with particularity in the appended claims. The figures are for illustration purposes only and are not drawn to scale. the invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-9 of the drawings in which like numerals refer to like features of the invention.

Figure 1:
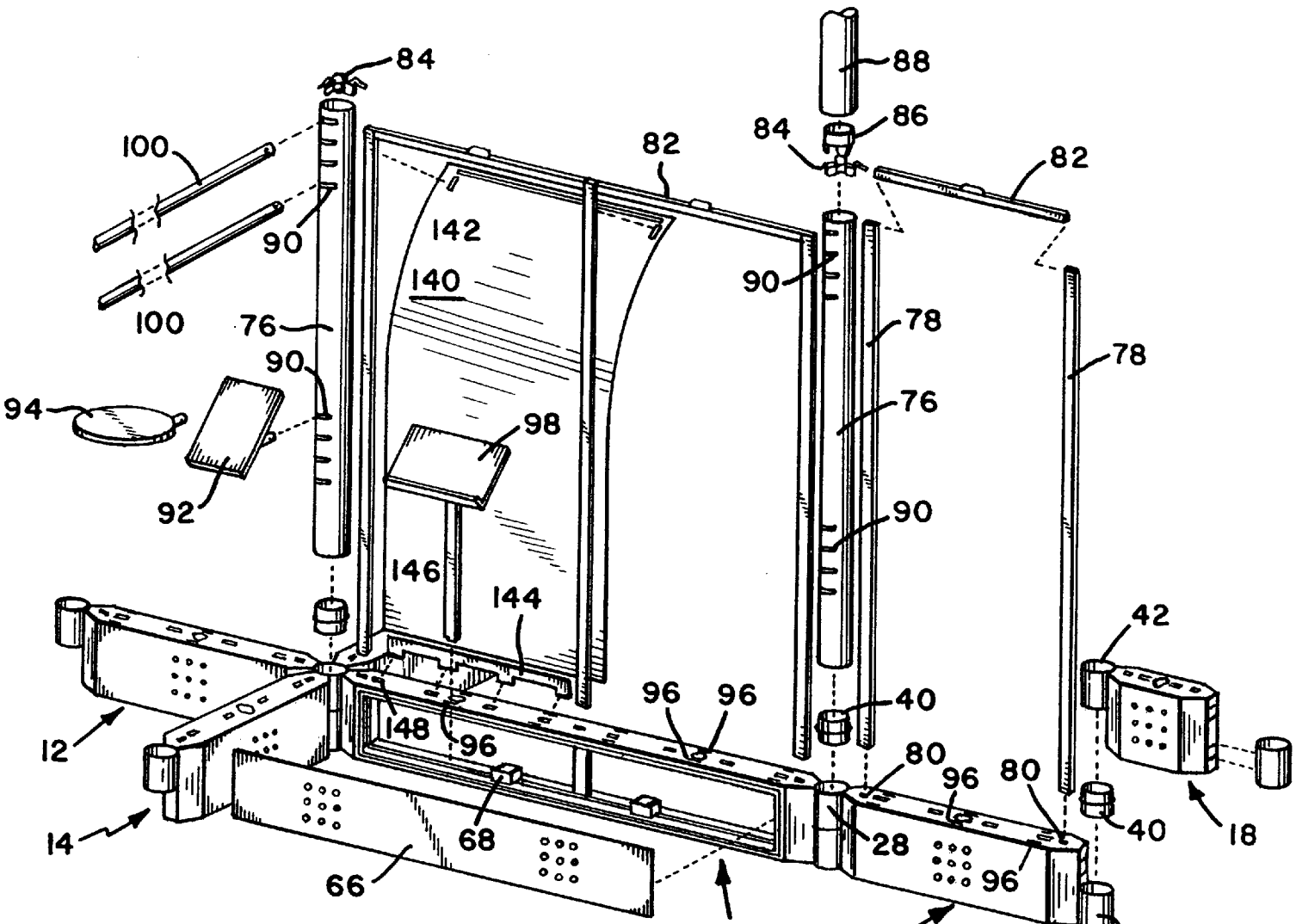
FIG. 1 is an exploded perspective view of the modular display system according to the present invention showing a variety of components and alternative base units.
Figure 4:
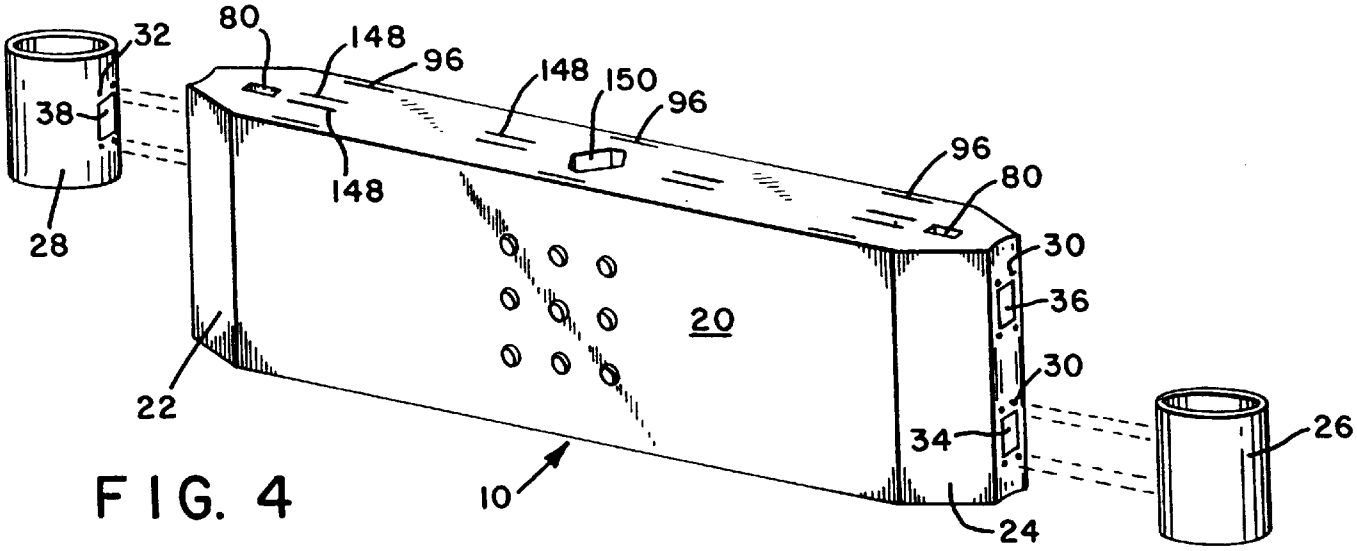
FIG. 4 is an exploded perspective view of a base unit according to the present invention illustrating how column collars may be attached at upper or lower positions on the body portion of a base unit.

Referring to FIGS. 1 and 4, the present invention includes base units 10, 12, 14, 16, 18 connected together to form part of the lower perimeter outline of a display area. Additional base units of the same types will generally be used to complete the display area. The display may be generally linear, and positioned along a wall, or more often, will form an island type booth viewable from all sides.

Referring to FIG. 4, a basic single base unit 10 includes a body 20 having angled ends 22, 24 that are adapted to receive detachable end members 26, 28. The end members preferably comprise cylindrical column collars of the type shown. Alternative shapes for the end members are various types of regular polygons including; hexagons, octagons and the like which permit the end members to be engaged at different angular positions as described below.

The end members 26, 28 can be attached to the body 20 at either end and at either an upper position (as shown for end member 28) or at a lower position (as shown for end member 26). As illustrated for each of the base units in FIG. 1, the majority of base units will include one column collar mounted at the lower position and one column collar mounted at the upper position. The column collars 26, 28 are attached to the body 20 by four bolts (not shown) that extend through holes 30 in the body and through holes 32 in the end member. The body holes 30 can be seen on end 24 of the body 20 and holes 32 can be seen in end member 28.

Holes 30 are located at the corners of openings 34, 36 on the base 10 and holes 32 are located at the corners of corresponding hole 38 in end member 28. Opening 38 in the end member aligns with either opening 36 or 38 depending on whether the end member is attached at the upper or lower position. This alignment provides access between the interior of the column collars and the interior of the body 20 which allows cables and wiring to be connected continuously along the perimeter of the display area.

Figure 3A:
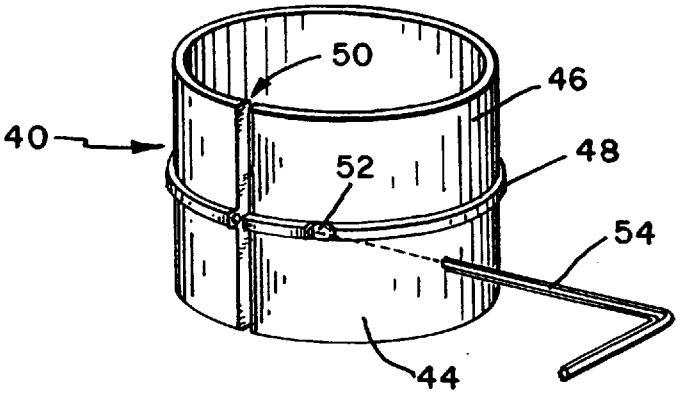
FIG. 3*a* is a perspective view of a column ring at an enlarged scale and also shows a tool for expanding the column ring.
Figure 3:
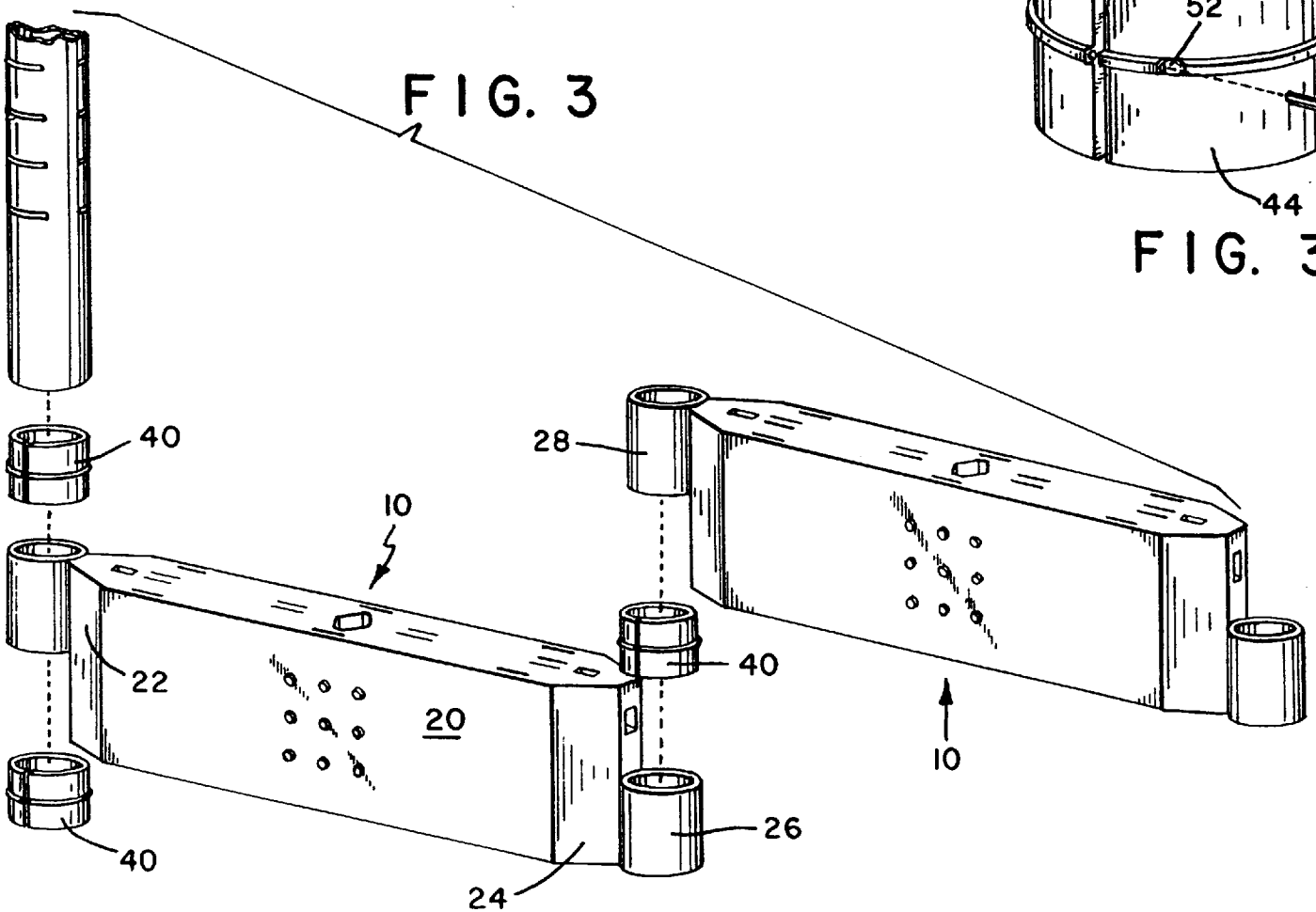
FIG. 3 is an exploded perspective view of the base units of FIG. 1 showing how the base units are connected together.

As can be seen in FIG. 1, base units 16 and 18 are attached on opposite sides of base unit 10 to form the perimeter of the display area by inserting column ring 40 between the lower end member (such as end member 26 on base unit 10) and the upper end member (such as upper end member 42 on base unit 18). This assembly method is seen in FIG. 3 in which two identical base units 10 are assembled into a portion of the lower perimetrical edge of the display area by positioning column ring 40 into lower end member 26 and then setting the upper end member 28 onto the column ring As can be seen best in FIG. 3*a*, the column ring includes a lower portion 44 having an outside diameter just slightly smaller then the inside diameter of the column collar 26. The upper portion 46 also has an outside diameter just slightly smaller then the inside diameter of upper column collar 28. A raised lip 48 surrounds the center of column ring 40 and prevents it from dropping down into column collar 26. The outer diameter of ring 48 may be equal to the outer diameter of the column collars 26 and 28.

With the base units connected as shown, they may be pivoted like a hinge to any desired relative angle between the base units. As can be seen in FIG. 3*a*, the column ring is preferably split vertically at 50 and an expanding set screw at 52 may be rotated with tool 54 to expand the width of slot 50 so as to prevent further angular rotation between the adjacent base units. In this manner, the adjacent base units may be locked together and wear of the column ring may be compensated for by adjusting the diameter of the column ring.

The ends of the body 20 are angled such that the angled ends fall within an acute angle of 60° measured from either side of the longitudinal axis of the body. This allows the adjacent base units to swing relative to each other over a 240° arc from 60° on one side through 180° (in line) to 60° on the opposite side. This allows the base units to be assembled in an equilateral triangle relationship, if desired, forming a display space having interior angles of 60° between the walls.

As may be seen in FIG. 1, the length of the base units may be varied from a standard length (base unit 10, 12, 14) to a double length (base unit 16) or a half length (base unit 18). Other length variations are also possible.

It is expected that the majority of base units will be pre-assembled into a standard configuration as shown in FIG. 3 with one end member mounted in the upper position and one in the lower position. The base units will then be connected to define the display area as needed to fit the available space. The base units are conveniently movable and repositionable at this time before any vertical elements have been added and before displays or walls have been attached.

It will be understood that display areas will generally not be completely enclosed around the perimeter. At the end of the base units, the corresponding end members may be removed, or two end members may be connected, one on top of each other to a single base unit.

Figure 5D:
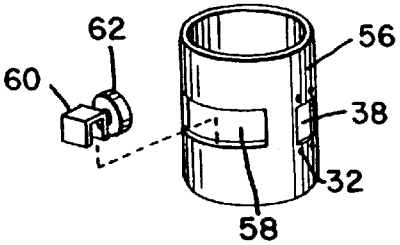
FIG. 5 is a perspective view showing how multiple base units may be connected together at a central point according to the present invention.
FIG. 5*a* is a perspective view at an enlarged scale showing a modified column collar and clamp used in assembling the multiple base unit configuration of FIG. 5.

As can be seen in FIG. 1, it is also possible to arrange multiple base units in a star so that they are connected at a single connection point as may be seen at the intersection of base units 12, 14 and 16. This connection may be achieved simply by removing the end member from base unit 14 and bringing it to the intersection of base units 12 and 16, or more preferably, by using a modified end member such as end member 56 seen in FIG. 5*a*.

End member 56 includes opening 38 and holes 32 used to attach it to the upper position of base unit 16, and also includes an extra opening 58 which matches opening 36 at the upper position of the body portion of base unit 14. Opening 58 is sufficiently wide so that the outwardly projecting base unit 14 can be positioned at varying angles between 60° relative to base unit 16 up to 120° relative to base unit 16 . Opening 36 in the end of base unit 14 is attached to opening 58 by placing clamp 60 over the adjacent edges of openings 36 and 58 and tightening thumb screw 62 to secure base unit 14 to column collar 56.

Figure 5:
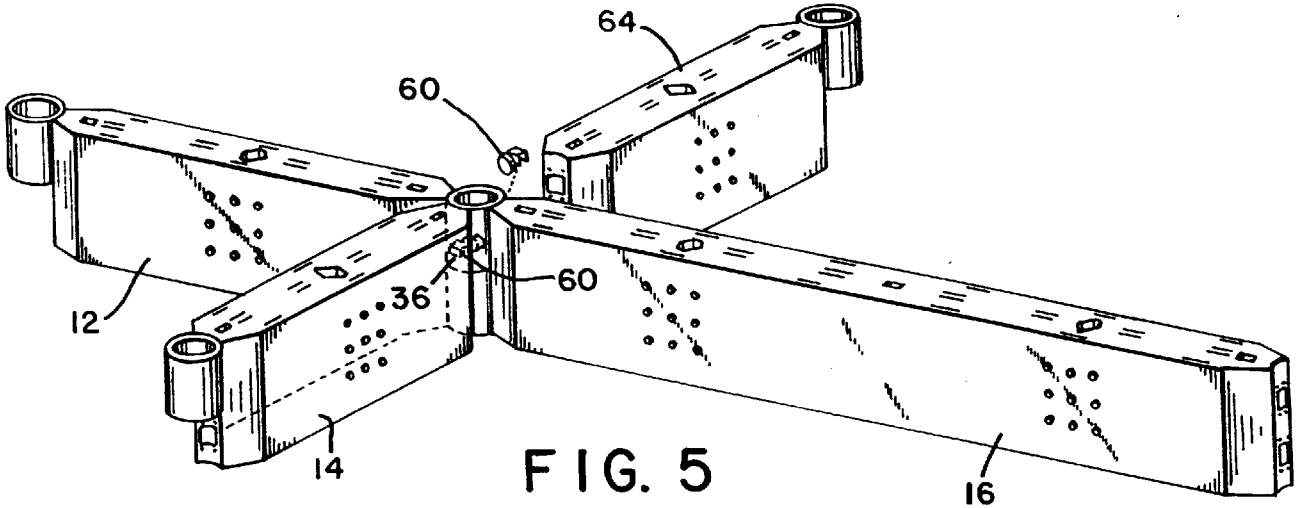

A corresponding connection may be made to base unit 64, extending oppositely outward from base unit 14 in FIG. 5, if more base units are to be positioned on the opposite side of the display area wall defined by units 12 and 16.

Referring to FIG. 1, it will be seen that the base unit 16 is provided with a front cover 66 allowing access to its hollow interior. Base units 10,12, 14 and 18, and all other base units are also provided with front covers and hollow interiors. The front covers fit flush within a recess on the face of each base unit and are attached with clips, latches, magnetically or by any other desired conventional means which allows them to be easily removed.

Figure 9:
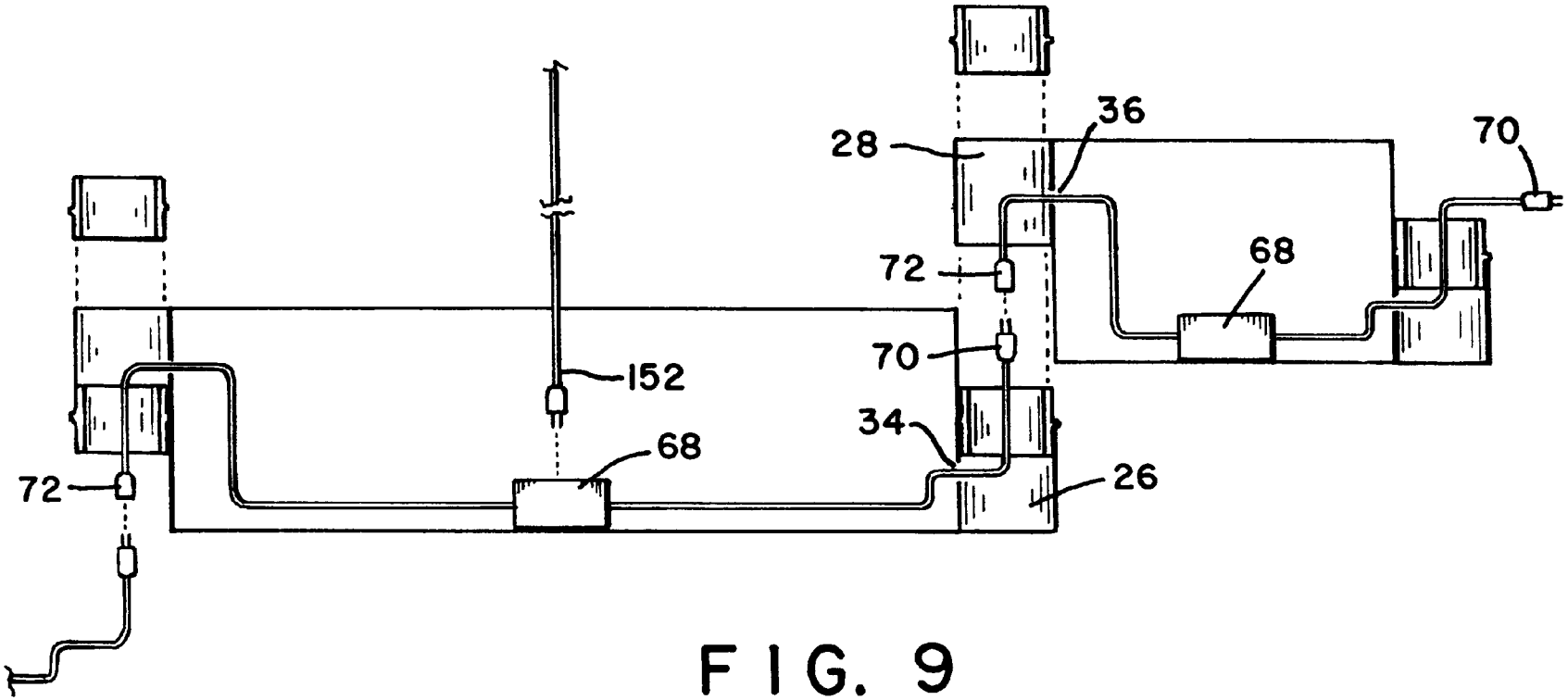
FIG. 9 is a front elevational view in diagrammatic cross section showing electrical interconnections between outlets in the base units and wiring to adjacent base units as well as connection to lights and other electrical accessories.

Inside each hollow base unit there are one or more electrical outlets 68. Referring to FIG. 9, it can be seen that each outlet 68 is provided with a plug 70 and a receptacle 72. The plug from one outlet 68 extends through the lower opening 34 in the end of the body and up to a corresponding receptacle 72 which is connected via a wire passing through the upper opening 36 in the adjacent base unit. As the base units are assembled, electrical connections are easily made in a chain from the outlet in one base unit to the outlet in the next base unit. At one end of the chain the plug is connected to a conventional power source and all outlets are then powered.

It will also be understood that alternative arrangements for plugs and sockets can be used. Further, the chain-like arrangement of the plugs and receptacles may be matched by a chain-like arrangement of communication or control cables as may be desired for setting up local area networks, printers, computer systems or telephone circuitry, etc. Alternatively, long cables may be passed continuously through the openings after the perimeter of the display area is established.

After the display area is defined using the various base units assembled in the manner described, the walls are constructed through the use of vertical supports and crossbars. In the preferred design shown in FIG. 1, two types of vertical supports are used. First, columns 76 are installed using column rings 40 that engage the upper end members 28 on each base unit. Second, uprights 78 are inserted into corresponding sleeves 80 in the base units.

Sleeves 80 are formed of tubing have a rectangular cross section which has internal dimensions to exactly match the outer dimensions of uprights 78. The sleeves 80 extend downward into the interior of the base unit and are closed at the bottom end to limit the depth that the uprights 78 extend into the base unit. Crossbars 82 extend between uprights 78, and spiders 84 fit into the upper ends of columns 76.

The spiders 84 engage the upper ends of uprights 78 to maintain the spacing between the column and upright and to add strength and rigidity to the structure. Where desired, a notched column ring 86 may be positioned in the upper end of a column 76 over a spider 84 allowing a column extension 88 to extend the height of the column. Column extensions may carry banners, additional advertising material, flags and the like.

Columns 76 and uprights 78 are independently strong enough to provide the necessary vertical support and the present invention may be constructed without the uprights 78 or without the columns 76, as desired. However the preferred design uses both structures, both for aesthetic reasons and because the column 76 is provided with various auxiliary attachment points and support openings 90 which may be used to suspend display plates 92 or shelves 94 to support items for display or provide labels and informational material to those viewing the displays.

Figure 6:
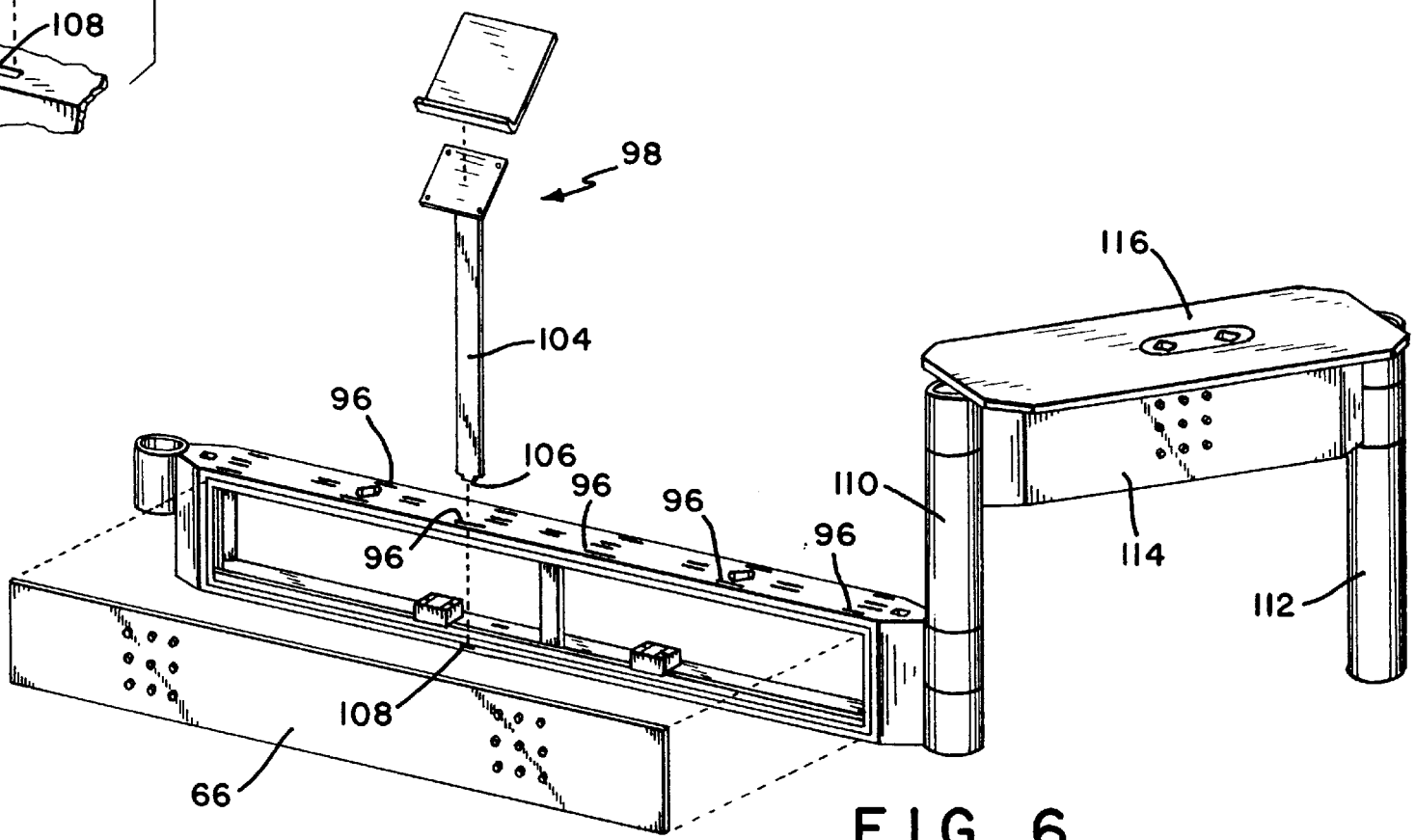
FIG. 6 is a perspective view of the present invention illustrating display accessories, table accessories and an alternative method of connecting adjacent base units.
Figure 6D:
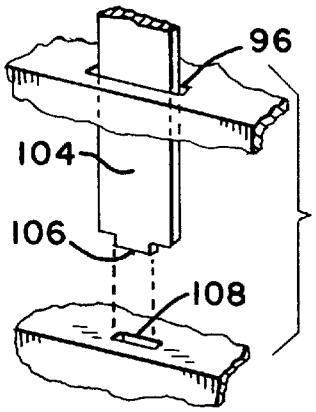
FIG. 6*a* is a detail perspective view illustrating the method of attaching a display accessory to the base unit shown in FIG. 6.
Figure 7:
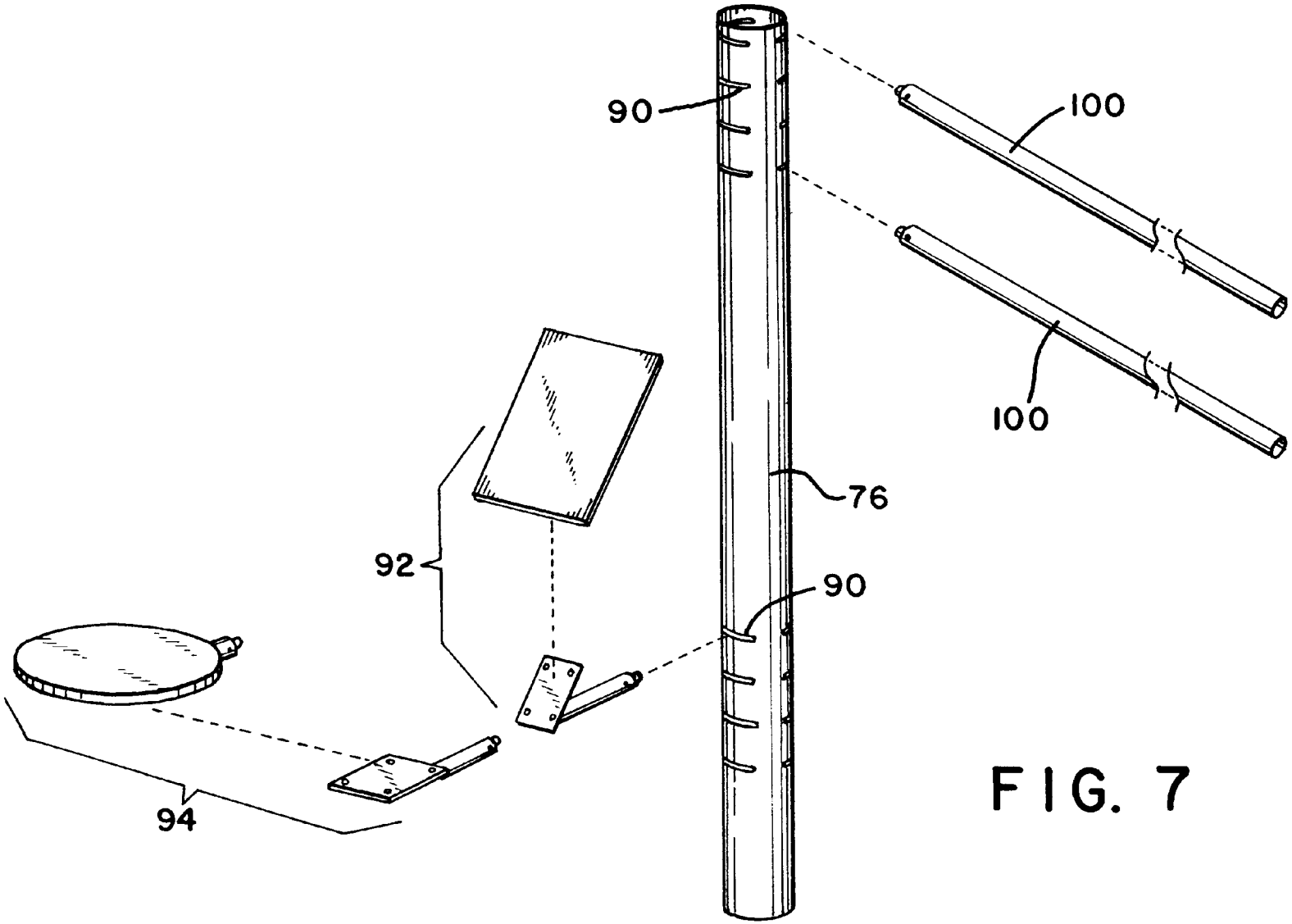
FIG. 7 is a perspective view of the present invention illustrating vertical columns and the method of attachment of shelves and display bars to vertical columns.

Referring to FIGS. 1 and 6, a similar system on the base unit includes vertical support opening 96 along the front upper edge of the base unit which receives vertical display accessories such as display stand 98. Referring to FIGS. 1 and 7, openings 90 on column 76 may also be used for light weight display crossbars 100 that may support banners.

Referring to FIGS. 6 and 6*a*, it can be seen that the vertical display stands such as display 98 include a display stand upright 104 which extends through opening 96. Display upright 104 includes a tab 106 at its lower end which engages a corresponding opening 108 at the bottom edge of the body unit.

As may also be seen in FIG. 6, column extensions 110, 112 of various lengths may be used to support base units off the ground such as base unit 114 and accessories such as table 116 may be attached to the upper surface to provide display space and/or working space.

Figure 8:
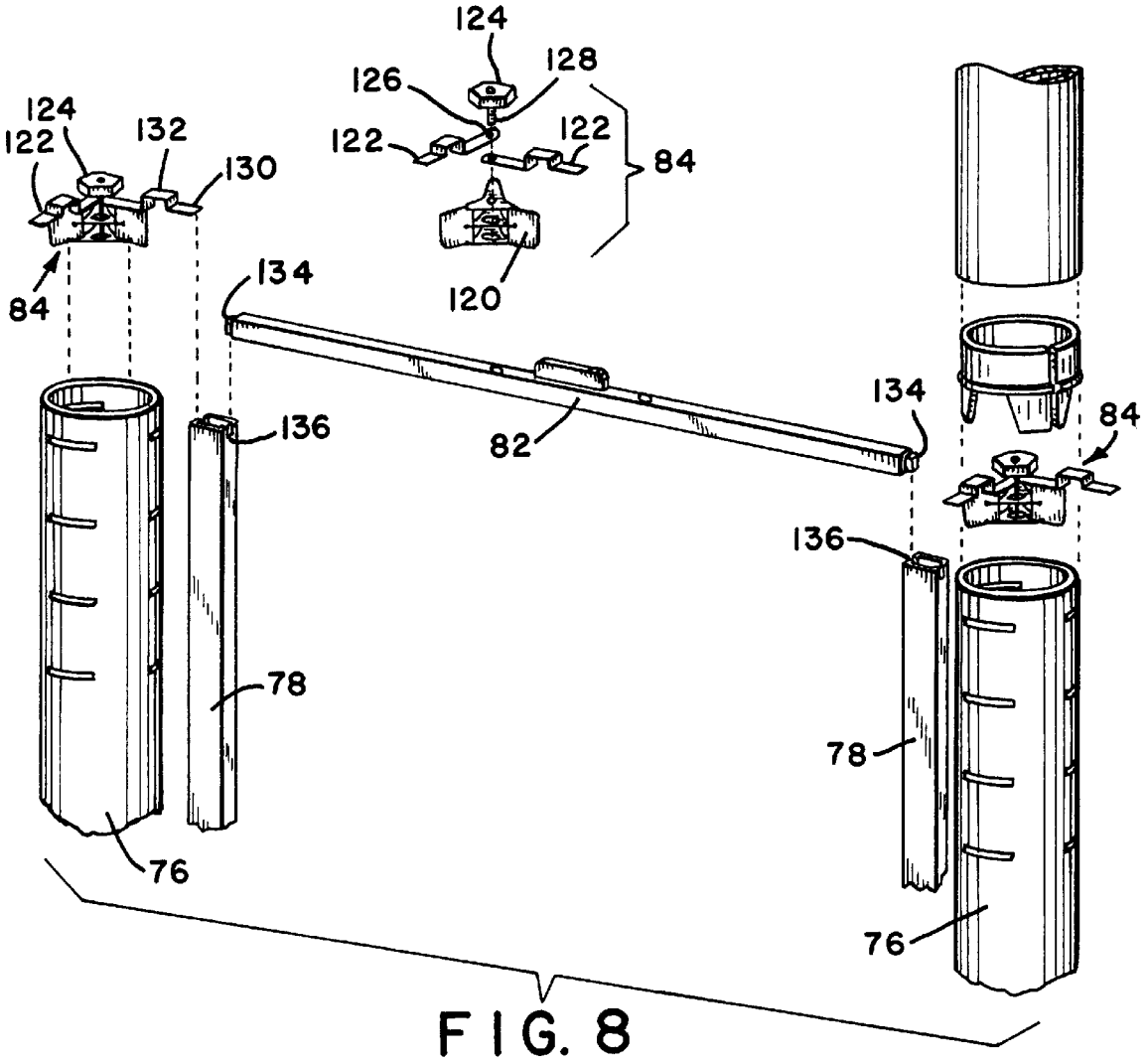
FIG. 8 is a perspective view of the upper ends of columns and uprights illustrating interconnection between the upper ends with spiders and crossbars and illustrating the use of notched column rings and column extensions.

The upper ends of columns 76 and uprights 78 are shown in FIG. 8. Spider 84 is composed of a spider base 120, and one or more spider fingers 122 attached with a threaded knob 124. The spider fingers 122 include a hole 126 through which threaded end 128 of knob 124 extends. The spider fingers are free to rotate about threaded end 128 to any desired angle as necessary to correspond to the angles between adjacent base units on opposite sides of column 76. The assembled spider 84 with knob 124 slightly loosened is inserted into the upper end of column 76. The spider finger 122 at end 130 is dropped into the upper end of upright 78.

Portion 132 of spider finger 122 maintains the distance between column 76 and upright 78 corresponding to the distance between these elements at the base. The spider fingers prevent relative motion between column 76 and upright 78. Crossbar 82 includes tangs 134 which engage corresponding slots 136 at the upper end of uprights 78. Multiple spider fingers 122 may be attached at each column to match the number of base units projecting outward from the column at the base so that each upright 78 is properly spaced and supported.

Knob 124 is then tightened. The upper surface of knob 124 lies approximately flush with the upper surface of crossbar 82 and the upper ends of column 76 and upright 78.

Upon completion of the installation of vertical supports and crossbars, the shape and height of the display area is defined. Referring to FIG. 1, display materials 140 are then attached to the inner and outer surfaces of the uprights 78 and crossbars 82. Typically the display materials will be in flexible sheet form and they may be attached by hook and loop fastener material 142 at the top and along the edges.

A convenient method of installation which provides accurate alignment of the sheet material to the base is to attach an overlay base tab 144 to the bottom of display material 140. Tabs 146 along the bottom edge of the overlay base tab 144 engage corresponding slots 148 which lie in pairs in alignment with the inner surface and outer surface of uprights 78 and corresponding sleeve openings 80 (see FIG. 4). Provided that the base tab 144 is correctly attached to display material 140, positioning tabs 146 in slots 148 will accurately position the bottom end of display material 140 and allow it to be quickly attached with hook fastener material 142 to corresponding loop fastener material strips (not shown) on the uprights.

Display slots 148 on the inside and outside edges of the base units allow different display materials to be positioned on the outside of the display area from those appearing on the inside of the display area. Light fixtures may be also affixed at the top to the crossbar 82 and electrical wiring can be located between the inner and outer surfaces of the displays. Openings 150 (see FIG. 4) allow plugs 152 (see FIG. 9) to reach the electrical outlets 68 located within the interior of the base units.

Figure 2:
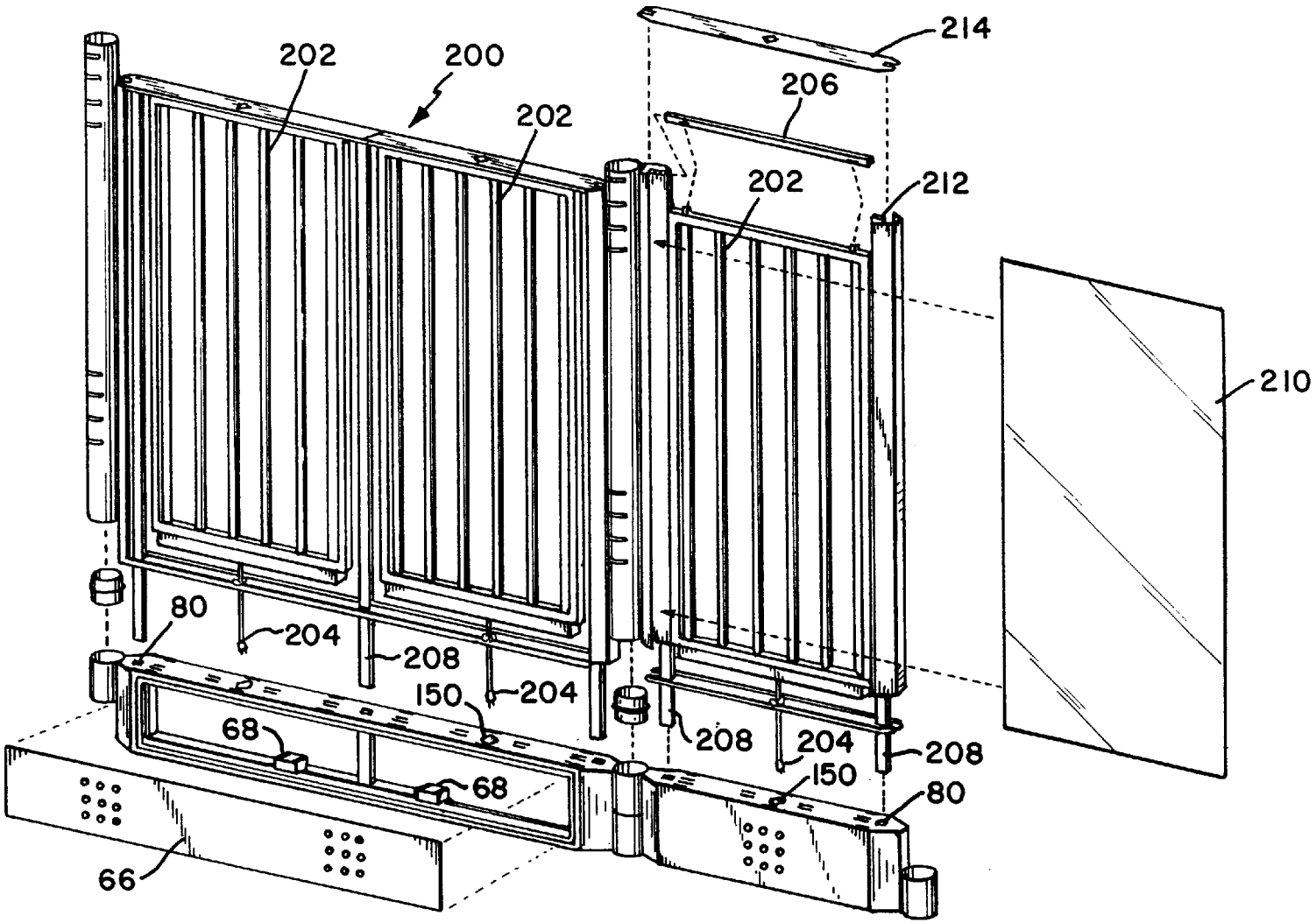
FIG. 2 is an exploded perspective view of alternative components of the display system in which lighting is integrated into the vertical elements for back-illuminated display materials.

FIG. 2 illustrates an optional accessory in which semi-transparent or transparent sheet material displays and advertising 210 is back illuminated with lighting fixtures 200. The lighting fixtures 200 include a plurality of fluorescent tubes 202. Conventional fluorescent tube ballast boxes (not shown) are positioned along the edges of the fixtures 200 to operate the fluorescent tubes 202, and the ballast boxes are supplied with power through plugs 204 which extend through openings 150 and connect to outlets 68 inside the body of the base unit.

The lighting fixtures include crossbars 206 and are supported with integrated support uprights 208. The support uprights 208 fit into sleeves 80 in the same manner previously described. Transparent sheet material 210 fits into a recess 212 around the inside perimeter of the frame surrounding the lighting fixture 200 and a cap plate 214 is positioned on the upper surface. Different back illuminated advertising sheet materials 210 may be positioned on the inner and outer surfaces of the display.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A modular display system comprising:

a plurality of hollow base units angularly positionable relative to one another on a floor area to define a lower edge of a display space, each base unit including:

an elongated body having opposed ends, the opposed ends having upper and lower positions for mounting end members at different heights relative to the floor area, and a pair of detachable end members connectable to the opposed ends of the elongated body at the upper position or the lower position, each end member connected to the body at the lower position being connectable at a plurality of angles to an end member on an adjacent base unit, the end member on the adjacent base unit being connected to the end of the body of the adjacent base unit at the upper position; and a plurality of vertical supports for supporting display materials, the vertical supports having upper and lower ends, the lower ends being removably connectable to the base units.

2. The modular display system of claim 1 further including a plurality of crossbars removably connectable to the upper ends of the vertical supports for defining an upper edge of the display space.

3. The modular display system of claim 2 wherein:

the vertical supports comprise uprights; and the elongated body of the base units includes sleeves engaging the lower ends of the uprights.

4. The modular display system of claim 1 wherein:

the vertical supports comprise columns; and the lower ends of the columns connect to end members connected at the upper position to the body.

5. The modular display system of claim 1 wherein the end members comprise cylindrical column collars.

6. The modular display system of claim 4 wherein:

the vertical supports also include uprights; and the elongated body of the base units includes sleeves engaging the lower ends of the uprights.

7. The modular display system of claim 6 further including:

spiders for connecting the columns to adjacent uprights; and crossbars for connecting the upper ends of uprights.

8. The modular display system of claim 7 wherein the spiders are angularly adjustable.

9. The modular display system of claim 1 wherein the bodies of the base units include openings for receiving accessory display supports.

10. The modular display system of claim 1 wherein the bodies of the base units include electrical outlets.

11. The modular display system of claim 10 wherein the electrical outlets include connecting wires with plugs, the connecting wires having sufficient length to allow adjacent base units to be electrically connected together in chain-like fashion.

12. The modular display system of claim 1 wherein the hollow base units include a removable face plate and electrical outlets within the hollow base units.

13. The modular display system of claim 1 wherein the opposed ends of the base units and the end members cooperate to allow angular adjustment of adjacent base units over an angle of at least 240°.

14. A modular display system comprising:

a plurality of base units angularly positionable relative to one another on a floor area to define a lower edge of a display space, each base unit including:

an elongated body having opposed ends, and a pair of detachable end members connectable to the opposed ends of the elongated body at upper or lower positions, each end member connected to the body at the lower position being connectable at a plurality of angles to an end member on an adjacent base unit, the end member on the adjacent base unit being connected to the end of the body of the adjacent base unit at the upper position; and a plurality of vertical supports for supporting display materials, the vertical supports having upper and lower ends, the lower ends being removably connectable to the base units;

the end members comprising cylindrical column collars and column collars from adjacent base units being connected together with column rings positioned between and engaging the column collars from adjacent base units.

15. The modular display system of claim 14 wherein the column rings are adjustable in diameter to lock together column collars from adjacent base units.

16. The modular display system of claim 14 wherein each column ring comprises a lower half, an upper half and a ring therebetween, the ring having a larger outside diameter than the upper or lower half of the column collar.

17. A modular display system comprising:

a plurality of hollow base units angularly positionable relative to one another on a floor area to define a lower edge of a display space, each base unit including:

an elongated body having opposed ends and vertical support sleeves, the opposed ends having upper and lower positions for mounting end members at different heights relative to the floor area, and a pair of detachable end members connectable to the opposed ends of the elongated body at the upper position or the lower position, each end member connected to the body at the lower position being connectable at a plurality of angles to an end member on an adjacent base unit, the end member on the adjacent base unit being connected to the end of the body of the adjacent base unit at the upper position; and a plurality of upper units having vertical supports with lower ends, the lower ends of the vertical supports being engaged by the vertical support sleeves to support the upper units on the base units.

18. The modular display system of claim 17 wherein the upper units comprise light units for illuminating display materials from the back.

19. The modular display system of claim 18 wherein the light units project light in a forward direction and in a rearward direction to illuminate display materials positioned on the front and on the rear of the light units.

* * * * *